US012325101B2

(12) United States Patent
Kinoshita et al.

(10) Patent No.: US 12,325,101 B2
(45) Date of Patent: Jun. 10, 2025

(54) POLISHING APPARATUS AND POLISHING METHOD

(71) Applicant: EBARA CORPORATION, Tokyo (JP)

(72) Inventors: Masaki Kinoshita, Tokyo (JP); Takashi Kishi, Tokyo (JP); Toshiki Miyakawa, Tokyo (JP)

(73) Assignee: EBARA CORPORATION, Tokyo (JP)

( * ) Notice: Subject to any disclaimer, the term of this patent is extended or adjusted under 35 U.S.C. 154(b) by 363 days.

(21) Appl. No.: 18/086,200

(22) Filed: Dec. 21, 2022

(65) Prior Publication Data

US 2023/0201991 A1 Jun. 29, 2023

(30) Foreign Application Priority Data

Dec. 28, 2021 (JP) ..... 2021-213796

(51) Int. Cl.
*B24B 37/04* (2012.01)
*B24B 37/20* (2012.01)

(52) U.S. Cl.
CPC ..... *B24B 37/042* (2013.01); *B24B 37/205* (2013.01)

(58) Field of Classification Search
CPC ..... B24B 7/228; B24B 37/013; B24B 37/005; B24B 37/015; B24B 37/205; B24B 37/095; B24B 49/12; B24B 49/14; B24B 55/02; B24B 55/03
USPC ..... 451/6, 41, 287, 527, 8, 5, 286, 488
See application file for complete search history.

(56) References Cited

U.S. PATENT DOCUMENTS 9,017,140 B2 * 4/2015 Allison ..... B24B 37/205 451/526
2003/0124957 A1 * 7/2003 Kobayashi ..... B24B 37/013 451/41
2013/0273814 A1 * 10/2013 Kobayashi ..... B24B 37/013 451/6

FOREIGN PATENT DOCUMENTS

JP 2002-063946 A 2/2002
JP 2004-160609 A 6/2004
JP 2017-220683 A 12/2017

* cited by examiner

*Primary Examiner* — Robert F Neibaur
(74) *Attorney, Agent, or Firm* — BakerHostetler

(57) ABSTRACT

A polishing apparatus capable of preventing condensation on an inner surface of a transparent window provided in a polishing pad and capable of achieving accurate measuring of a film thickness is disclosed. The polishing apparatus includes: a polishing pad having a polishing surface; a polishing head configured to press a workpiece against the polishing surface; a transparent window disposed in the polishing pad; a polishing table configured to support the polishing pad; an optical sensor head located below the transparent window and configured to direct light to the workpiece through the transparent window and receive reflected light from the workpiece through the transparent window; and a cooling device configured to cool a space between the transparent window and the optical sensor head.

13 Claims, 9 Drawing Sheets

POLISHING APPARATUS AND POLISHING METHOD

CROSS REFERENCE TO RELATED APPLICATION

This document claims priority to Japanese Patent Application No. 2021-213796 filed Dec. 28, 2021, the entire contents of which are hereby incorporated by reference.

BACKGROUND

In a manufacturing process of a semiconductor device, various materials are repeatedly formed in film shapes on a silicon wafer to form a multilayer structure. In order to form such multilayer structure, a technique of planarizing a surface of an uppermost layer of the multilayer structure is important. Chemical mechanical polishing (CMP) is used as one of such planarizing techniques.

The chemical mechanical polishing (CMP) is performed by a polishing apparatus. This type of polishing apparatus generally includes a polishing table that supports a polishing pad, a polishing head configured to hold a wafer having a film, and a polishing-liquid supply nozzle configured to supply a polishing liquid (for example, slurry) onto the polishing pad. The polishing apparatus is configured to supply the polishing liquid from the polishing-liquid supply nozzle onto the polishing pad while rotating the polishing head and the polishing table. The polishing head presses a surface of the wafer against the polishing pad in the presence of the polishing liquid between the wafer and the polishing pad to thereby polish a film that forms the surface of the wafer.

In order to measure a thickness of a film, such as insulating film or silicon layer (hereinafter simply referred to as film thickness), the polishing apparatus may include an optical film-thickness measuring device. This optical film-thickness measuring device is configured to direct light emitted by a light source to a surface of a wafer through a sensor head, receive reflected light from the wafer with the sensor head, and analyze a spectrum of the reflected light to determine a film thickness of the wafer. The polishing apparatus can terminate the polishing of the wafer or change polishing conditions of the wafer based on the determined film thickness.

During polishing of the wafer, the polishing liquid and polishing debris are present on the polishing pad. If the polishing liquid or the polishing debris adheres to the sensor head, intensity of the light irradiating the wafer and intensity of the reflected light from the wafer decrease, and as a result, accurately measuring of the film thickness cannot be achieved. Thus, there is a technique of providing a transparent window between the sensor head and the wafer. The transparent window is arranged in the polishing pad. The light is directed through the transparent window onto the wafer, and the reflected light from the wafer passes through the transparent window and is received by the sensor head. The transparent window provided in the polishing pad can prevent the polishing liquid and the polishing debris from contacting the sensor head, thereby ensuring a good optical path.

After polishing of the wafer, water may be supplied onto the polishing pad in order to clean the polished surface of the wafer or the polishing pad. However, the water supplied onto the polishing pad cools the transparent window provided in the polishing pad, and condensation may occur on an inner surface (back surface) of the transparent window. In particular, during polishing of the wafer, a temperature of the polishing pad increases due to friction between the polishing pad and the wafer. If the transparent window is rapidly cooled with the water after polishing of the wafer, the condensation is likely to occur on the inner surface (back surface) of the transparent window. The condensation on the inner surface of the transparent window blocks the passage of light and lowers the accuracy of measuring of the film thickness during polishing of a subsequent wafer.

SUMMARY

There are provided a polishing apparatus and a polishing method capable of preventing condensation on an inner surface of a transparent window provided in a polishing pad and capable of achieving accurate measuring of a film thickness.

Embodiments, which will be described below, relate to a technique of measuring a film thickness of a workpiece while polishing the workpiece (e.g., wafer, substrate, or panel) used in manufacturing of semiconductor devices, and in particular to a technique of determining a film thickness of the workpiece based on optical information contained in reflected light from the workpiece.

In an embodiment, there is provided a polishing apparatus comprising: a polishing pad having a polishing surface; a polishing head configured to press a workpiece against the polishing surface; a transparent window disposed in the polishing pad; a polishing table configured to support the polishing pad; an optical sensor head located below the transparent window and configured to direct light to the workpiece through the transparent window and receive reflected light from the workpiece through the transparent window; and a cooling device configured to cool a space between the transparent window and the optical sensor head.

In an embodiment, the cooling device has a cooling surface exposed in the space.

In an embodiment, the polishing apparatus further comprises an operation controller configured to control a cooling operation of the cooling device.

In an embodiment, the operation controller is configured to instruct the cooling device to start the cooling operation after polishing of the workpiece.

In an embodiment, the operation controller is configured to instruct the cooling device to start the cooling operation during polishing of the workpiece.

In an embodiment, the operation controller is configured to calculate a temperature difference by subtracting a temperature in the space from a temperature of the polishing surface, and control the cooling operation of the cooling device such that the temperature difference is maintained not less than a threshold value.

In an embodiment, the polishing apparatus further comprises a dehumidifying device configured to reduce humidity in the space.

In an embodiment, there is provided a polishing method comprising: polishing a workpiece by pressing the workpiece against a polishing surface of a polishing pad; during polishing of the workpiece, directing light from an optical sensor head to the workpiece through a transparent window disposed in the polishing pad, and receiving reflected light from the workpiece through the transparent window by the optical sensor head; and cooling a space between the transparent window and the optical sensor head by a cooling device.

In an embodiment, the cooling device has a cooling surface exposed in the space.

In an embodiment, cooling of the space by the cooling device is started after polishing of the workpiece.

In an embodiment, cooling of the space by the cooling device is started during polishing of the workpiece.

In an embodiment, the polishing method further comprises calculating a temperature difference by subtracting a temperature in the space from a temperature of the polishing surface, wherein cooling the space by the cooling device comprises cooling the space by the cooling device such that the temperature difference is maintained not less than a threshold value.

In an embodiment, the polishing method further comprises reducing humidity in the space.

According to the above-described embodiments, the temperature in the space between the transparent window and the optical sensor head is lowered by the cooling device. As a result, a temperature of a dew point in the space is lowered, thus preventing condensation on the inner surface of the transparent window facing the space.

DESCRIPTION OF EMBODIMENTS

Embodiments will be described below with reference to the drawings.

Figure 1:
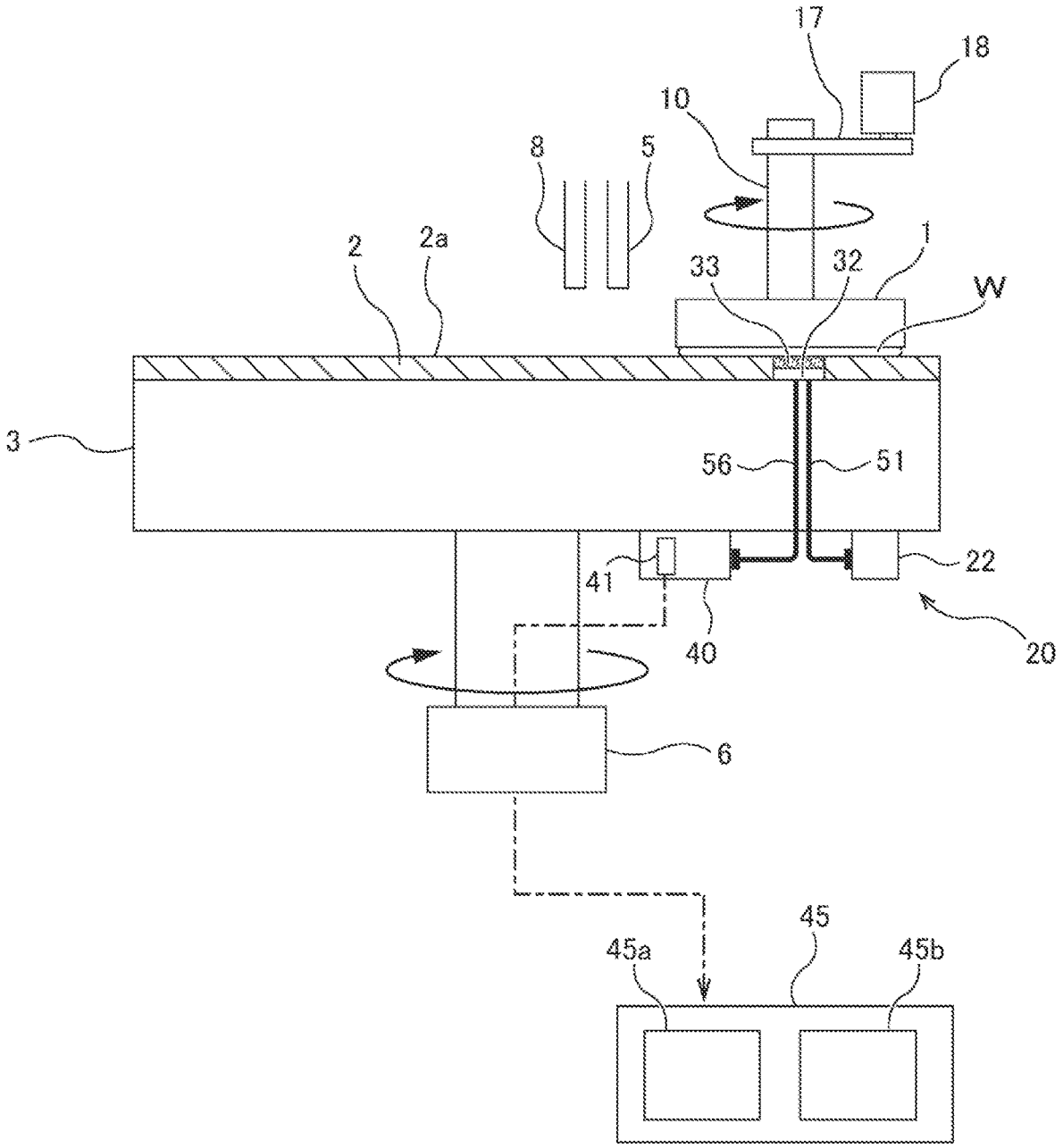
FIG. 1 is a schematic diagram showing an embodiment of a polishing apparatus.

FIG. 1 is schematic view showing an embodiment of a polishing apparatus. As shown in FIG. 1, the polishing apparatus includes a polishing table 3 configured to support a polishing pad 2, a polishing head 1 configured to press a workpiece W (e.g., wafer, substrate, panel, etc. used in manufacturing of semiconductor devices) against the polishing pad 2, a table motor 6 configured to rotate the polishing table 3; a polishing-liquid supply nozzle 5 configured to supply a polishing liquid, such as slurry, onto the polishing pad 2, and a pure-water supply nozzle 8 configured to supply pure water onto the polishing pad 2 after polishing of the workpiece W. The polishing pad 2 has an upper surface constituting a polishing surface 2*a* for polishing the workpiece W.

The polishing head 1 is coupled to a head shaft 10, and the head shaft 10 is coupled to a polishing-head motor 18 via a coupling device 17. Structures of the coupling device 17 are not particularly limited, and may include a combination of pulleys and a belt, a combination of gears, a combination of sprockets and a chain, or the like. The polishing-head motor 18 is configured to rotate the polishing head 1 together with the head shaft 10 in a direction indicated by an arrow. The polishing table 3 is coupled to the table motor 6, which is configured to rotate the polishing table 3 and the polishing pad 2 in a direction indicated by an arrow.

Polishing of the workpiece W is performed as follows. The polishing-liquid supply nozzle 5 supplies the polishing liquid onto the polishing surface 2*a* of the polishing pad 2 on the polishing table 3, while the polishing table 3 and the polishing head 1 are rotated in directions indicated by the arrows in FIG. 1. While the workpiece W is being rotated by the polishing head 1, the workpiece W is pressed by the polishing head 1 against the polishing surface 2*a* of the polishing pad 2 in the presence of the polishing liquid on the polishing pad 2. The surface of workpiece W is polished by a chemical action of the polishing liquid and a mechanical action of abrasive grains contained in the polishing liquid and/or the polishing pad 2.

The polishing apparatus includes a film-thickness measuring device 20 configured to measure a film thickness of the workpiece W. The film-thickness measuring device 20 includes a light source 22 configured to emit light, an optical sensor head 32 configured to direct the light, emitted by the light source 22, to the workpiece W and receive reflected light from the workpiece W, a spectrometer 40 coupled to the optical sensor head 32, a spectrum processing device 45 configured to determine a film thickness of the workpiece W based on intensity measurement data of the reflected light from the workpiece W, and a transparent window 33 arranged above the optical sensor head 32. The transparent window 33 is arranged in the polishing pad 2, and the optical sensor head 32 is mounted to the polishing table 3. The transparent window 33 and the optical sensor head 32 rotate together with the polishing table 3.

Each time the polishing table 3 makes one rotation, the light emitted by the light source 22 is transmitted to the optical sensor head 32 and is directed from the optical sensor head 32 to the surface of the workpiece W. The light reflects off the surface of the workpiece W and the reflected light from the surface of the workpiece W is received by the optical sensor head 32 and transmitted to the spectrometer 40. The spectrometer 40 decomposes the reflected light according to wavelengths over a predetermined wavelength range and measures the intensity of the reflected light at each wavelength to generate the intensity measurement data of the reflected light. The intensity measurement data of the reflected light is sent from the spectrometer 40 to the spectrum processing device 45.

The spectrum processing device 45 is configured to produce a spectrum of the reflected light of the workpiece W from the intensity measurement data of the reflected light. This spectrum of the reflected light is expressed as a line graph (i.e., a spectral waveform) indicating a relationship between the wavelength and the intensity of the reflected light. The intensity of the reflected light can also be represented by a relative value, such as a reflectance or a relative reflectance.

The spectrum processing device 45 includes a memory 45*a* storing programs therein, and an arithmetic device 45*b* configured to perform arithmetic operations according to instructions included in the programs. The spectrum processing device 45 is composed of at least one computer. The memory 45*a* includes a main memory, such as random-access memory (RAM), and an auxiliary memory, such as a hard disk drive (HDD) or a solid-state drive (SSD).

Examples of the arithmetic device 45*b* include a CPU (central processing unit) and a GPU (graphic processing unit). However, the specific configurations of the spectrum processing device 45 are not limited to these examples.

Figure 2:
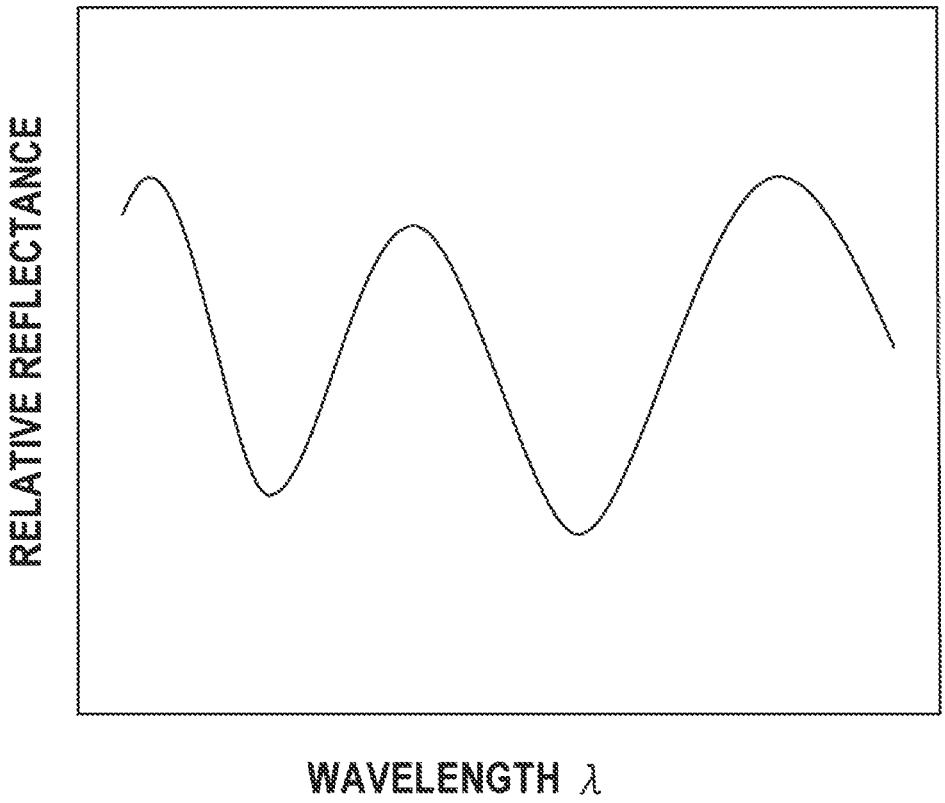
FIG. 2 is a schematic diagram showing an example of a spectrum generated by a spectrum processing device.

FIG. 2 is a diagram showing an example of a spectrum created by the spectrum processing device 45. The spectrum is represented as a line graph (i.e., a spectral waveform) showing the relationship between the wavelength and intensity of light. In FIG. 2, horizontal axis represents wavelength of the light reflected from the workpiece, and vertical axis represents relative reflectance derived from the intensity of the reflected light. The relative reflectance is an index value that represents the intensity of the reflected light. Specifically, the relative reflectance is a ratio of the intensity of the light to a predetermined reference intensity. By dividing the intensity of the light (i.e., the actually measured intensity) at each wavelength by a predetermined reference intensity, unwanted noises, such as a variation in the intensity inherent in an optical system or the light source of the apparatus, are removed from the actually measured intensity.

In the example shown in FIG. 2, the spectrum of the reflected light is a spectral waveform showing the relationship between the relative reflectance and the wavelength of the reflected light. The spectrum of the reflected light may be a spectral waveform showing a relationship between the intensity itself of the reflected light and the wavelength of the reflected light.

The spectrum processing device 45 is configured to receive the intensity measurement data of the reflected light from the workpiece W during one rotation of the polishing table 3 and generate the spectrum of the reflected light from the intensity measurement data. The spectrum processing device 45 is configured to determine the film thickness of workpiece W from the spectrum of the reflected light. Known technique is used for a method of determining the film thickness of the workpiece W based on the spectrum. For example, the spectrum processing device 45 determines a reference spectrum in a reference spectrum library that is closest in shape to the spectrum of the reflected light, and determines a film thickness associated with the determined reference spectrum. In another example, the spectrum processing device 45 performs a Fourier transform on the spectrum of the reflected light and determines a film thickness from a frequency spectrum obtained.

Details of the film-thickness measuring device 20 will be described with reference to FIG. 1. The spectrometer 40 has a photodetector 41. In one embodiment, the photodetector 41 comprises a photodiode, CCD, CMOS, or InGaAs (indium-gallium-arsenide) sensor. The optical sensor head 32 is optically coupled to the light source 22 and the photodetector 41. The photodetector 41 is electrically coupled to the spectrum processing device 45.

The film-thickness measuring device 20 includes a light-emitting optical fiber cable 51 configured to direct the light, emitted by the light source 22, to the surface of the workpiece W, and a light-receiving optical fiber cable 56 configured to receive the reflected light from the workpiece W and transmit the reflected light to the spectrometer 40. An end of the light-emitting optical fiber cable 51 and an end of the light-receiving optical fiber cable 56 are located in the polishing table 3. The optical sensor head 32 is composed of the end of the light-emitting optical fiber cable 51 and the end of the light-receiving optical fiber cable 56.

The light source 22 transmits the light through the light-emitting optical fiber cable 51 to the optical sensor head 32, which directs the light through the transparent window 33 to the workpiece W. The reflected light from the workpiece W travels through the transparent window 33 and is received by the optical sensor head 32. Further, the reflected light from the workpiece W is sent to the spectrometer 40 through the light-receiving optical fiber cable 56. The spectrometer 40 resolves the reflected light according to its wavelengths and measures the intensity of the reflected light at each wavelength over a predetermined wavelength range. The spectrometer 40 sends the intensity measurement data of the reflected light to the spectrum processing device 45. The spectrum processing device 45 generates a spectrum of the reflected light from the intensity measurement data of the reflected light and determines the film thickness of the workpiece W based on the spectrum of the reflected light.

Figure 3:
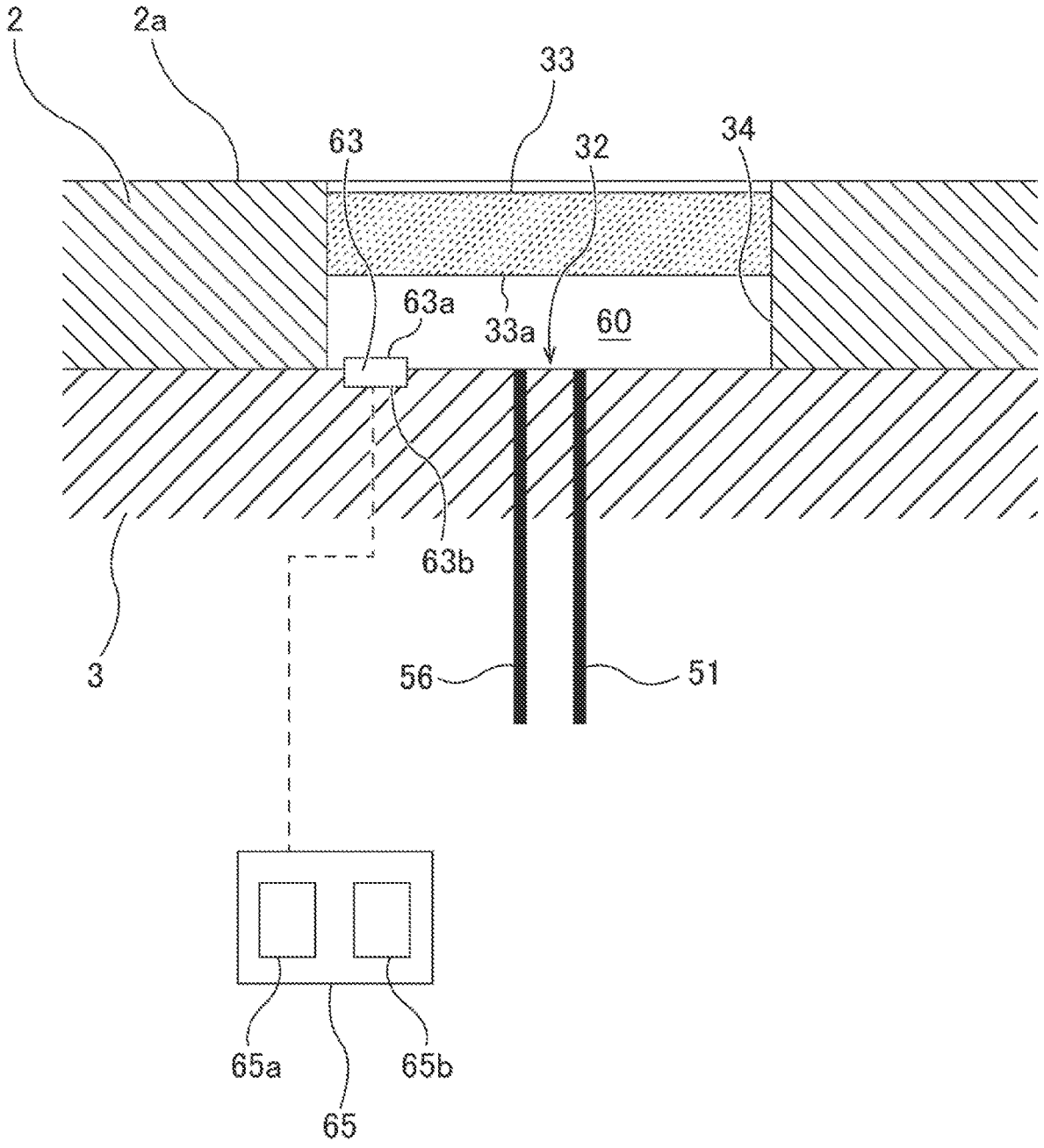
FIG. 3 is a cross-sectional view showing one embodiment of an arrangement of a transparent window and an optical sensor head.

FIG. 3 is a cross-sectional view showing one embodiment of an arrangement of the transparent window 33 and the optical sensor head 32. As shown in FIG. 3, the optical sensor head 32 is installed in the polishing table 3, and the transparent window 33 is arranged in a through-hole 34 formed in the polishing pad 2. The transparent window 33 completely closes the through-hole 34 of the polishing pad 2, thereby preventing the polishing liquid and the polishing debris from contacting the optical sensor head 32.

A space 60 is formed in the polishing pad 2. The space 60 is defined by an inner surface (or a back surface) 33*a* of the transparent window 33, the through-hole 34 of the polishing pad 2, and the polishing table 3. This space 60 is a closed space. The space 60 is located between the transparent window 33 and the optical sensor head 32. The inner surface 33*a* of the transparent window 33 and the optical sensor head 32 face the space 60. An outer surface of the transparent window 33 is at a position slightly lower than the polishing surface 2*a* of the polishing pad 2.

The optical sensor head 32, which constituted of the end of the light-emitting optical fiber cable 51 and the end of the light-receiving optical fiber cable 56, emits the light to the workpiece W through the space 60 and the transparent window 33. The reflected light from the workpiece W travels through the transparent window 33 and the space 60 and is received by the optical sensor head 32. The transparent window 33 is made of a material that allows the light to transmit therethrough. Although the material of the transparent window 33 is not particularly limited, the transparent window 33 may be made of transparent resin.

The polishing apparatus has a cooling device 63 configured to cool the space 60. The cooling device 63 has a cooling surface 63*a* exposed to the space 60. Examples of the cooling device 63 include a cooling element, a combination of a cooling element and a thermally conductive material, a water-cooling device, and the like. Examples of the cooling element include a Peltier element. Examples of the thermally conductive material include metal, such as copper, aluminum, or stainless steel.

In the embodiment shown in FIG. 3, the Peltier element is used as the cooling device 63. A part of the Peltier element that constitutes the cooling device 63 is located in the space 60 and other part of the Peltier element is located in the polishing table 3. More specifically, the cooling surface 63*a* of the Peltier element is exposed in the space 60 and a heat radiation surface 63*b* of the Peltier element is located in the polishing table 3.

Although not shown in the drawings, in one embodiment, a cooling surface of at least one cooling element (for example, a Peltier element) may be in contact with the heat radiation surface 63*b* of the cooling element (the Peltier element in this embodiment) that constitutes the cooling device 63 shown in FIG. 3, so that the cooling device 63 may be configured with a plurality of stacked cooling elements.

The plurality of stacked cooling elements can sequentially transfer heat of the space 60. In another embodiment, a water-cooling device may be in contact with the heat radiation surface 63*b* of the cooling element that constitutes the cooling device 63 shown in FIG. 3.

The cooling device 63 is coupled to an operation controller 65, so that a cooling operation of the cooling device 63 is controlled by the operation controller 65. The operation controller 65 includes a memory 65*a* storing programs therein, and an arithmetic device 65*b* configured to perform arithmetic operations according to instructions included in the programs. The operation controller 65 is composed of at least one computer. The memory 65*a* includes a main memory, such as random-access memory (RAM), and an auxiliary memory, such as a hard disk drive (HDD) or a solid-state drive (SSD). Examples of the arithmetic device 65*b* include a CPU (central processing unit) and a GPU (graphic processing unit). However, the specific configurations of the operation controller 65 are not limited to these examples.

During polishing of the workpiece W, a temperature of the polishing pad 2 increases due to friction between the polishing pad 2 and the workpiece W. After polishing of the workpiece W, pure water is supplied from the pure-water supply nozzle 8 onto the polishing surface 2*a* of the polishing pad 2 for the purpose of cleaning the polished surface of the workpiece W, cleaning the polishing pad 2, or dressing the polishing pad 2. With the supply of the pure water, the temperature of the transparent window 33 is lowered. As a result, dew condensation may occur on the inner surface (back surface) 33*a* of the transparent window 33. The condensation on the inner surface 33*a* of the transparent window 33 impedes the passage of light and lowers the accuracy of measuring of the film thickness during polishing of a subsequent workpiece.

Thus, in order to prevent the condensation on the inner surface 33*a* of the transparent window 33, the operation controller 65 instructs the cooling device 63 to cool the space 60. Cooling the space 60 by the cooling device 63 lowers a temperature of a dew point in the space 60, thereby preventing the condensation on the inner surface 33*a* of the transparent window 33 facing the space 60.

The operation controller 65 is configured to instruct the cooling device 63 to start its cooling operation after the workpiece W has been polished. For example, after polishing of the workpiece W and before or at the same time as the pure water is supplied onto the polishing pad 2, the operation controller 65 instructs the cooling device 63 to start the cooling operation.

In one embodiment, the operation controller 65 may be configured to instruct the cooling device 63 to start the cooling operation when the workpiece W is being polished. During polishing of the workpiece W, the temperature in the space 60 rises due to heat of the frictional between the polishing pad 2 and the workpiece W. When the temperature in the space 60 rises, the condensation is likely to occur on the inner surface 33*a* of the transparent window 33 as the transparent window 33 is cooled with the pure water after polishing of the workpiece W. Therefore, the operation controller 65 instructs the cooling device 63 to cool the space 60 during polishing of the workpiece W, so that the temperature in the space 60 (i.e., the temperature of the dew point) is lowered. Such operation can prevent the condensation on the inner surface 33*a* of the transparent window 33 facing the space 60 when the transparent window 33 is cooled with the pure water after the workpiece W is polished.

Figure 4:
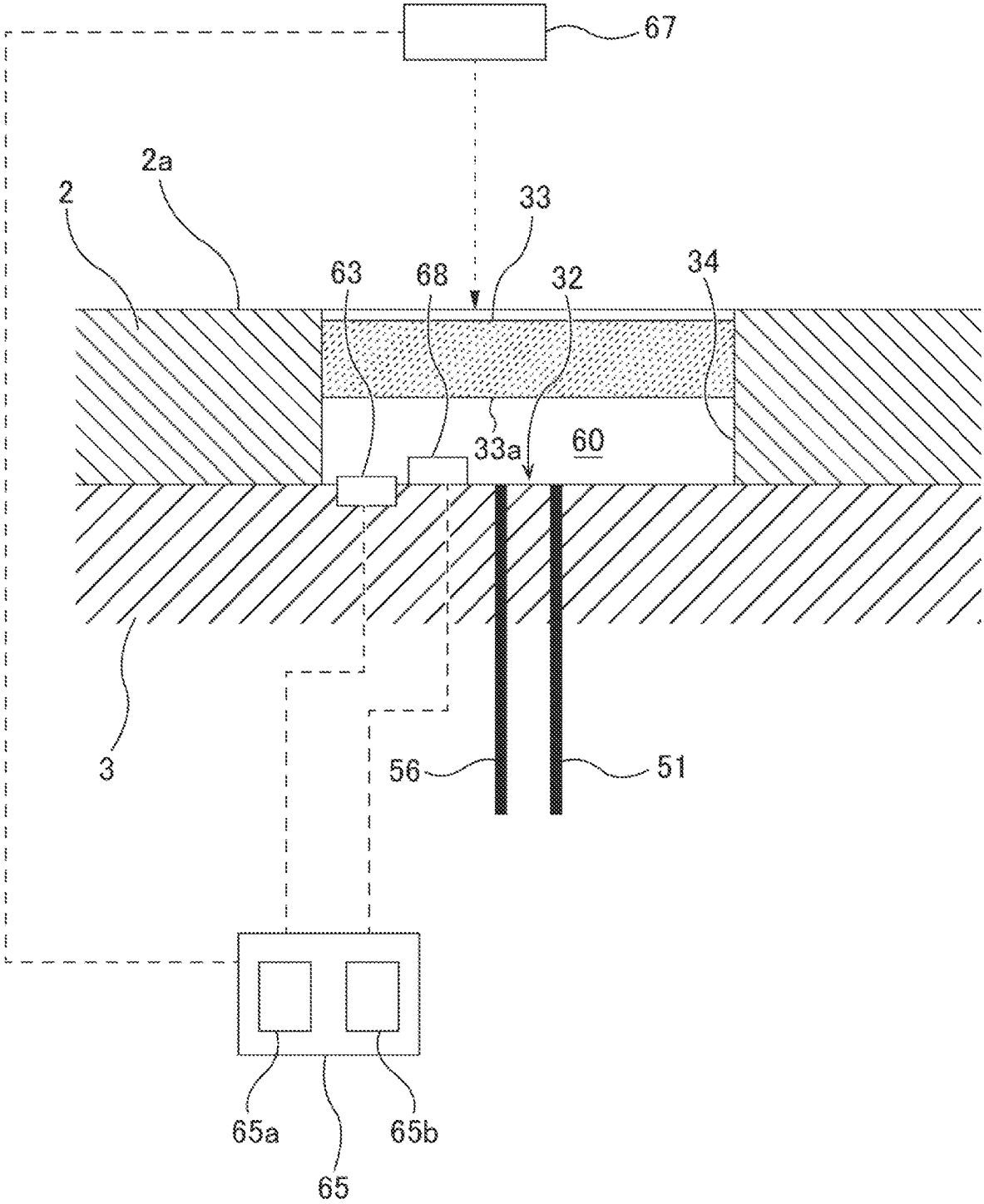
FIG. 4 is a cross-sectional view showing another embodiment of the arrangement of the transparent window and the optical sensor head.

FIG. 4 is a cross-sectional view showing another embodiment of the arrangement of the transparent window 33 and the optical sensor head 32. Configurations and operations of the present embodiment, which will not be particularly described, are the same as those of the embodiments described with reference to FIG. 3, and repetitive descriptions thereof will be omitted. In the embodiment shown in FIG. 4, the polishing apparatus includes a pad surface temperature measuring device 67 configured to measure the temperature of the polishing surface 2*a* of the polishing pad 2 (and the temperature of the transparent window 33), and an internal temperature measuring device 68 configured to measure the temperature in the space 60.

The pad surface temperature measuring device 67 may be a non-contact temperature sensor arranged above the polishing pad 2. For example, an infrared temperature sensor can be used as the pad surface temperature measuring device 67. The internal temperature measuring device 68 is located in the space 60. Arrangement and configuration of the internal temperature measuring device 68 are not particularly limited as long as the internal temperature measuring device 68 can measure the temperature in the space 60.

The pad surface temperature measuring device 67 and the internal temperature measuring device 68 are coupled to the operation controller 65, and a measured value of the temperature of the polishing surface 2*a* and a measured value of the temperature in the space 60 are sent to the operation controller 65. The operation controller 65 is configured to control the cooling operation of the cooling device 63 based on the measured value of the temperature of the polishing surface 2*a* and the measured value of the temperature of the space 60. More specifically, the operation controller 65 calculates a temperature difference by subtracting the measured value of the temperature of the space 60 from the measured value of the temperature of the polishing surface 2*a*, and controls the cooling operation of the cooling device 63 such that the temperature difference is maintained not less than a threshold value.

Such cooling operation can keep the temperature in the space 60 lower than the temperature of the polishing surface 2*a* at all times, thereby preventing the condensation on the inner surface 33*a* of the transparent window 33 facing the space 60. The threshold value for preventing the condensation tends to depend on an environment in which the polishing apparatus is placed, and therefore the threshold value may be determined from condensation observation data obtained in past polishing operations.

Figure 5:
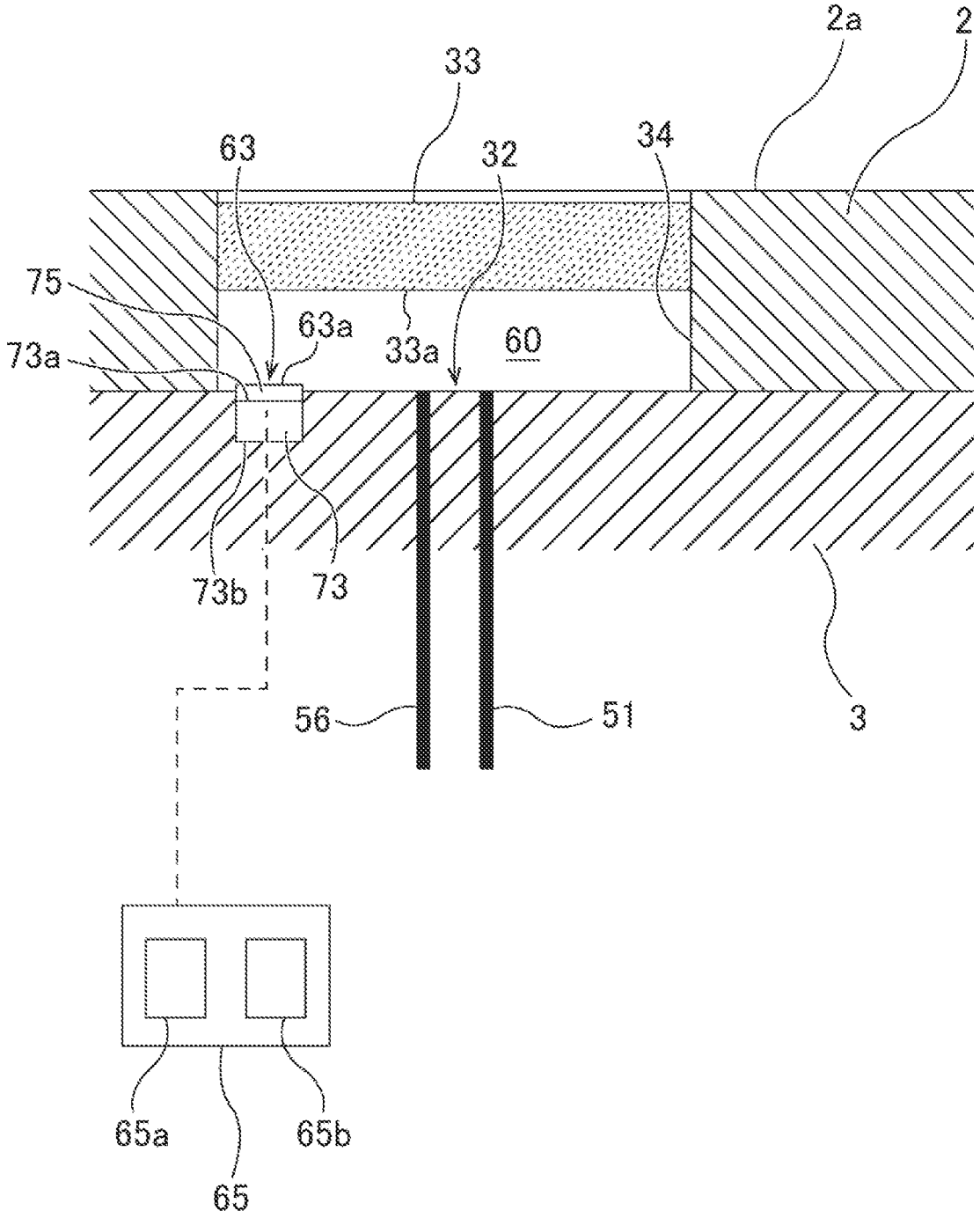
FIG. 5 is a schematic diagram showing one embodiment of a cooling device.

FIG. 5 is a schematic diagram showing another embodiment of the cooling device 63. Configurations and operations of the present embodiment, which will not be particularly described, are the same as those of the embodiments described with reference to FIG. 3, and repetitive descriptions thereof will be omitted. In this embodiment, the cooling device 63 includes a combination of a cooling element 73 and a thermally conductive material 75. More specifically, the entire cooling element 73 is located below the space 60 and outside the space 60. The thermally conductive material 75 is in contact with the cooling surface 73*a* of the cooling element 73. A part of the thermally conductive material 75 is located in the space 60 and other part of the thermally conductive material 75 is located in the polishing table 3. More specifically, a part of the thermally conductive material 75 is exposed in the space 60, and the cooling surface 63*a* of the cooling device 63 is composed of the exposed surface of the thermally conductive material 75. Examples of the cooling element 73 include a Peltier element, and examples of the thermally conductive material 75 include metal, such as copper, aluminum, or stainless steel.

According to the embodiment shown in FIG. 5, the thermally conductive material 75 is cooled by the cooling element 73, and the space 60 is cooled by the thermally conductive material 75. Since the entire cooling element 73, such as a Peltier element, is embedded in the polishing table 3, it is advantageous that heat radiated from the cooling element 73 is less likely to be transmitted to the space 60.

Although not shown in the drawings, in one embodiment, a cooling surface of at least one cooling element may be in contact with the heat radiation surface 73*b* of the cooling device 73, so that the cooling device 63 may be configured with a plurality of stacked cooling elements. The plurality of stacked cooling elements can sequentially transfer heat of the space 60. In another embodiment, a water-cooling device may be in contact with the heat radiation surface 73*b* of the cooling device 73.

Figure 6:
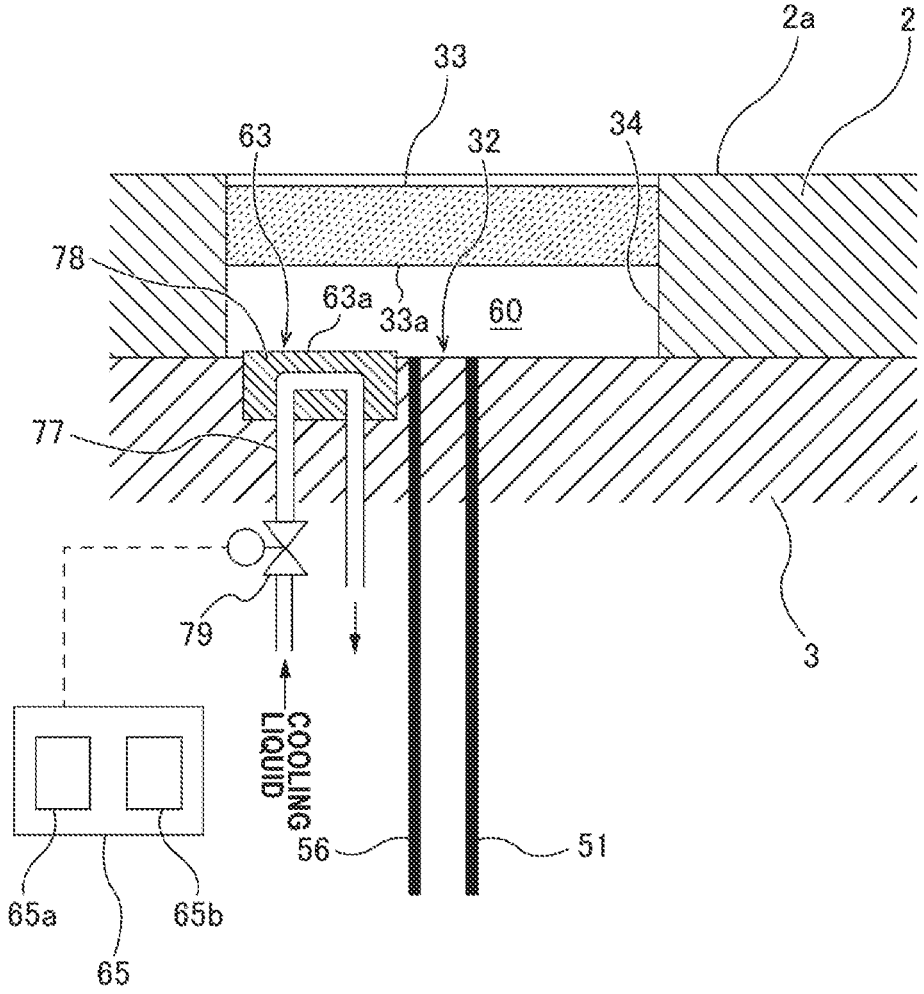
FIG. 6 is a schematic diagram showing one embodiment of the cooling device.

FIG. 6 is a schematic diagram showing still another embodiment of the cooling device 63. Configurations and operations of the present embodiment, which will not be particularly described, are the same as those of the embodiments described with reference to FIG. 3, and repetitive descriptions thereof will be omitted. In this embodiment, a water-cooling device is used as the cooling device 63. More specifically, the cooling device 63 includes a cooling-liquid flow passage 77 through which a cooling liquid, such as water, flows, and a thermally conductive material 78. At least a part of the thermally conductive material 78 is exposed in the space 60. The cooling-liquid flow passage 77 is located right below the space 60 and extends through the thermally conductive material 78.

In this embodiment, a part of the thermally conductive material 78 is located in the space 60 and other part of the thermally conductive material 78 is located in the polishing table 3. In one embodiment, the entire thermally conductive material 78 may be located in the space 60. The cooling surface 63*a* of the cooling device 63 is composed of an exposed surface of the thermally conductive material 78. The cooling liquid flowing through the cooling-liquid flow passage 77 cools the thermally conductive material 78, which can cool the interior of the space 60.

A flow control valve 79 is provided in the cooling-liquid flow passage 77, so that a flow rate of the cooling liquid flowing through the cooling-liquid flow passage 77 is regulated by the flow control valve 79. The flow control valve 79 is electrically coupled to the operation controller 65, and an operation of the flow control valve 79 is controlled by the operation controller 65.

The embodiments described with reference to FIG. 4 are applicable to the embodiments described with reference to FIGS. 5 and 6.

Figure 7:
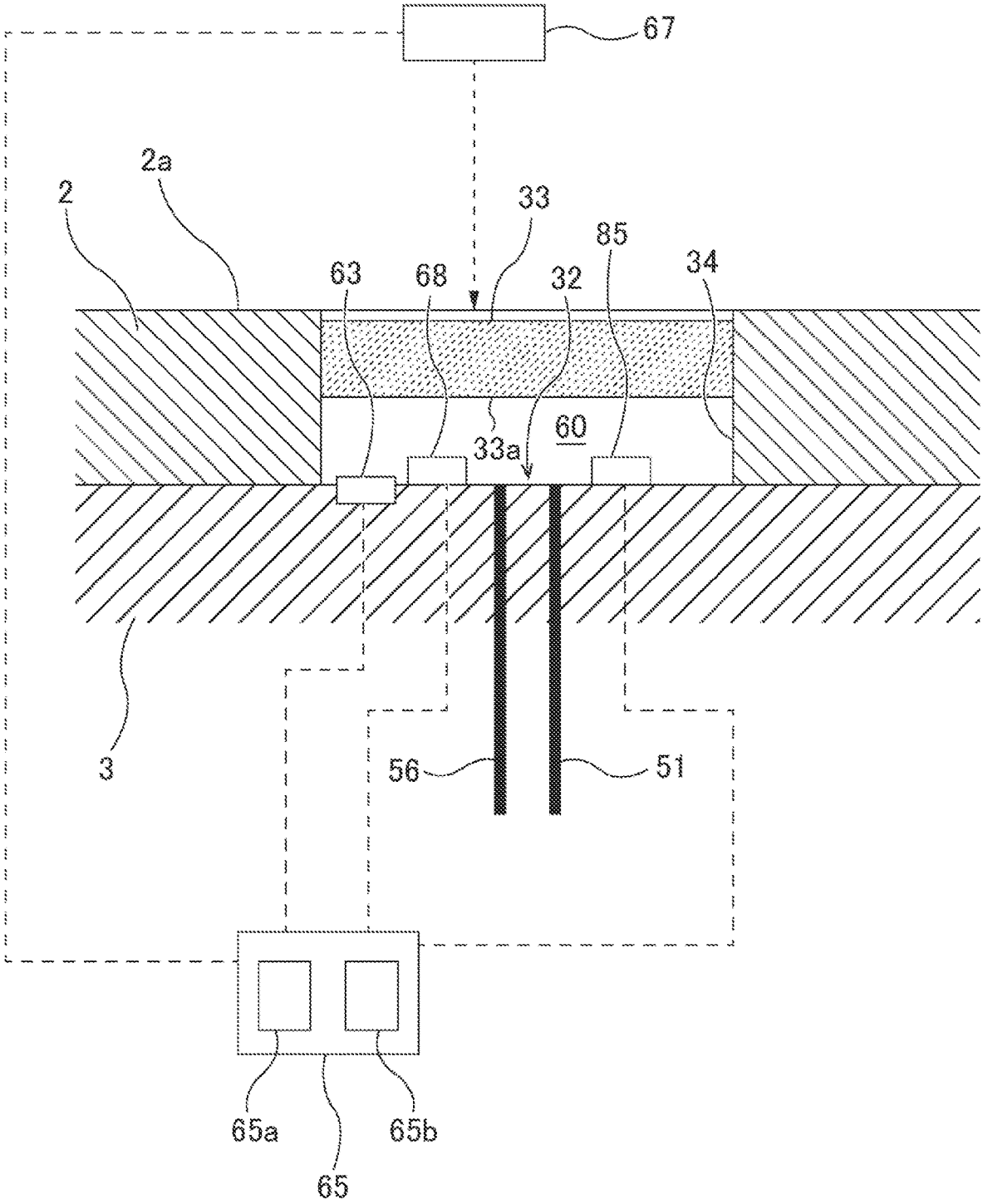
FIG. 7 is a cross-sectional view showing still another embodiment of the arrangement of the transparent window and the optical sensor head.

FIG. 7 is a cross-sectional view showing still another embodiment of the arrangement of the transparent window 33 and the optical sensor head 32. Configurations and operations of the present embodiment, which will not be particularly described, are the same as those of the embodiments described with reference to FIG. 4, and repetitive descriptions thereof will be omitted. In the embodiment shown in FIG. 7, the polishing apparatus includes a dehumidifying device 85 configured to reduce a humidity in the space 60. The dehumidifying device 85 is arranged in the space 60. Specific examples of the dehumidifying device 85 include a dehumidifying element having a solid polymer electrolyte membrane, a dry-gas dehumidifier configured to supply dry gas into the space 60, a dehumidifying agent, such as silica gel, and a combination thereof.

In this embodiment, the dehumidifying device 85 is composed of a dehumidifying element having a solid polymer electrolyte membrane. The dehumidifying device 85 is coupled to the operation controller 65, and a dehumidifying operation of the dehumidifying device 85 is controlled by the operation controller 65. The dehumidifying device 85 can remove moisture from the space 60, and can therefore prevent the condensation on the inner surface 33*a* of the transparent window 33 facing the space 60.

Figure 8:
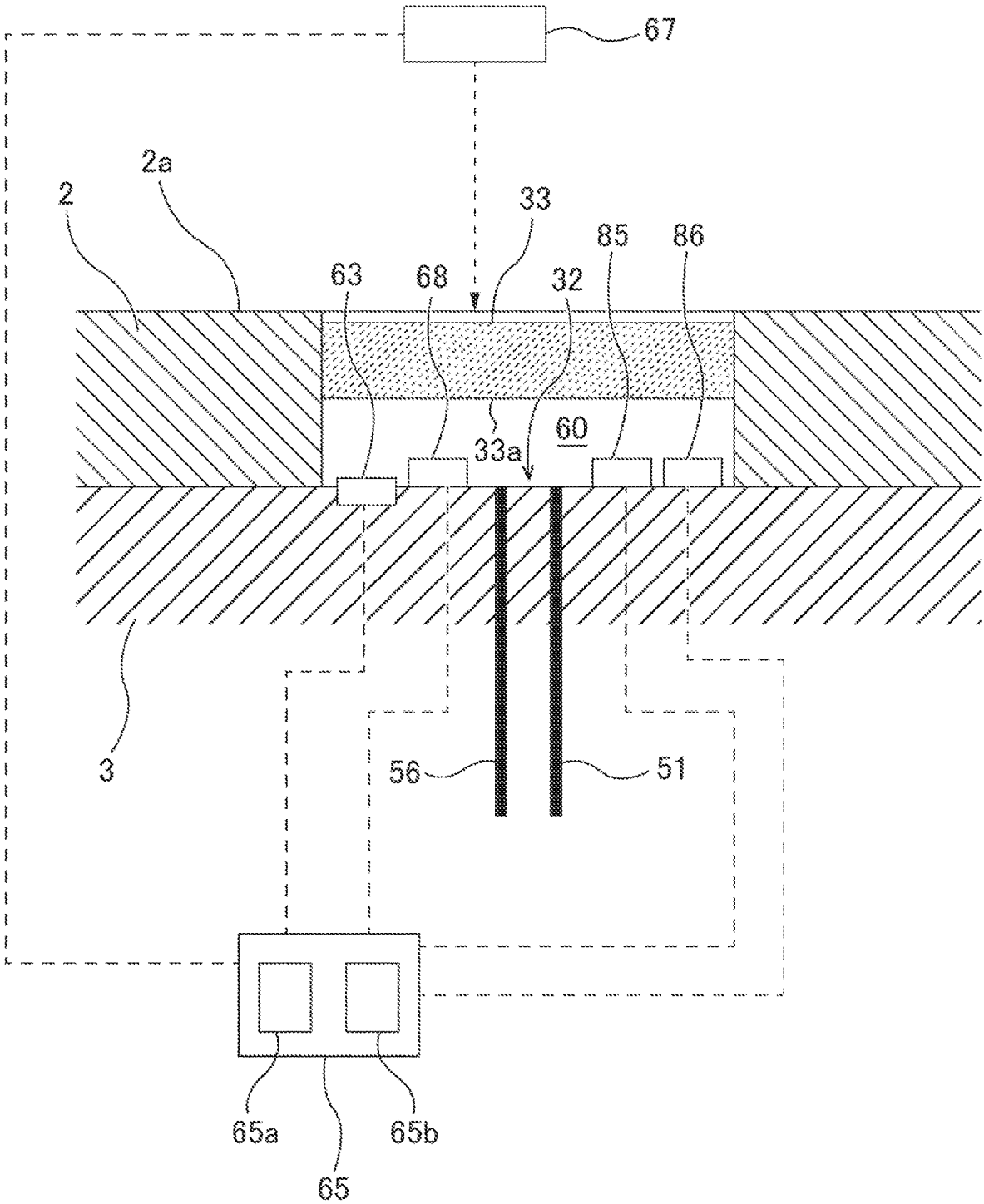
FIG. 8 is a cross-sectional view showing still another embodiment of the arrangement of the transparent window and the optical sensor head.

In one embodiment, as shown in FIG. 8, the polishing apparatus may further include a humidity measuring device 86 configured to measure the humidity in the space 60. The humidity measuring device 86 is arranged in the space 60. The humidity measuring device 86 is coupled to the operation controller 65 so that a measured value of the humidity in the space 60 is transmitted to the operation controller 65. The operation controller 65 is configured to control the dehumidifying operation of the dehumidifying device 85 based on the measured value of humidity in the space 60.

Figure 9:
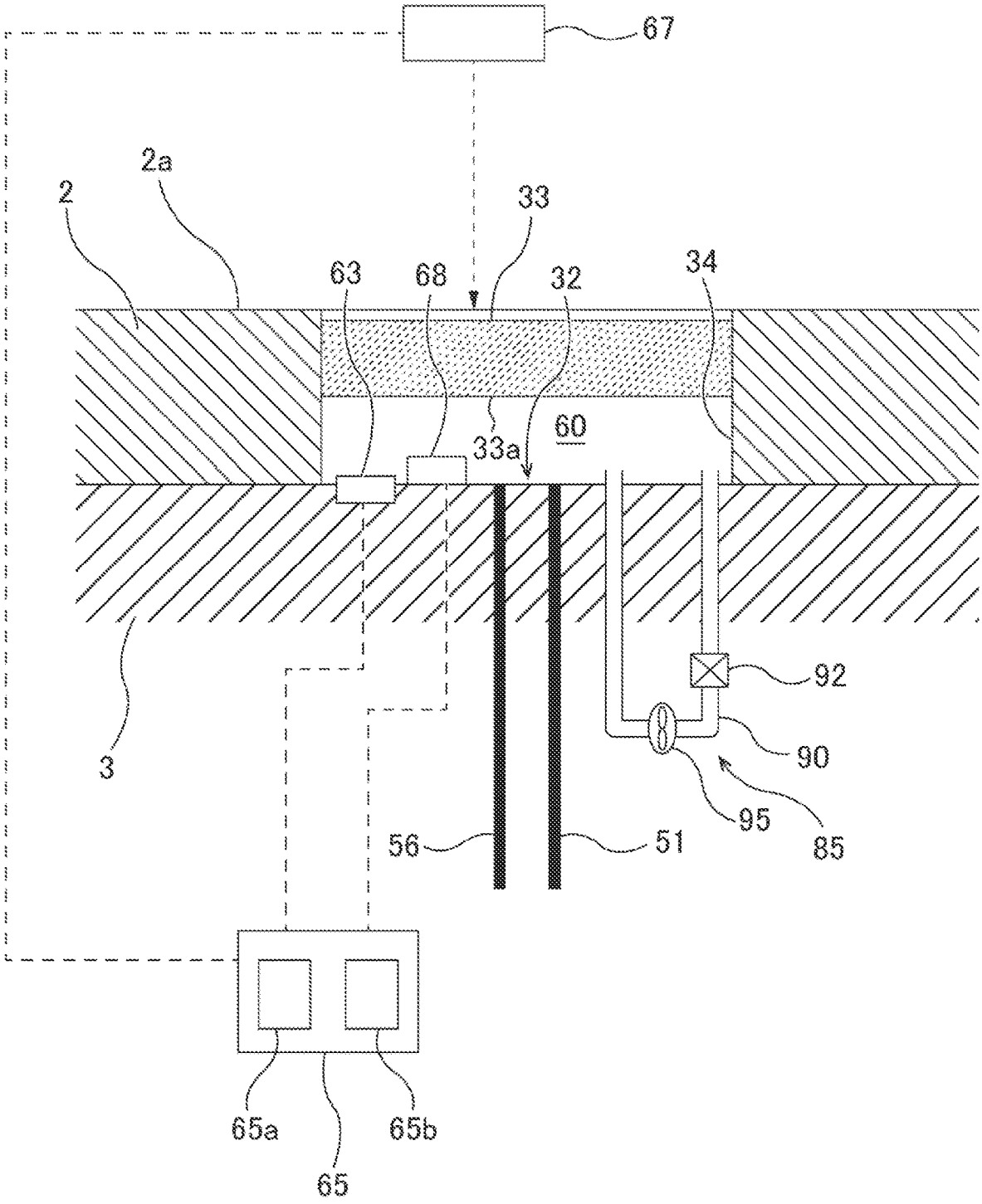
FIG. 9 is a schematic diagram showing an embodiment of a dehumidifier.

FIG. 9 is a schematic diagram showing another embodiment of the dehumidifying device 85. In this embodiment, the dehumidifying device 85 comprises a combination of a dry-gas dehumidifier and a dehumidifying agent. More specifically, the dehumidifying device 85 includes a dry-gas circulation line 90 through which dry gas (e.g., air) flows, a dehumidifying agent 92 provided in the dry-gas circulation line 90, and a fan 95 configured to deliver the dry gas in the dry-gas circulation line 90. Examples of the dehumidifying agent 92 include silica gel.

The dry-gas circulation line 90 opens in the space 60 and communicates with the space 60. When the fan 95 is in operation, the dry gas (e.g., air) flows from the dry-gas circulation line 90 into the space 60, fills the space 60, and then flows from the space 60 into the dry-gas circulation line 90. The dry gas that has flowed through the space 60 contacts the dehumidifying agent 92 and is dehumidified by the dehumidifying agent 92. The dehumidified dry gas flows into the space 60 again from the dry-gas circulation line 90. In this manner, the dry gas circulates between the space 60 and the dehumidifying agent 92. In one embodiment, instead of the dehumidifying agent 92, a dehumidifying element having a solid polymer electrolyte membrane may be provided.

The embodiments described with reference to FIG. 8 can be applied to the embodiments described with reference to FIG. 9. The embodiments described with reference to FIGS. 7 to 9 may be combined with any of the embodiments described with reference to FIGS. 3 to 6.

In the embodiments described so far, the polishing apparatus includes one set of transparent windows 33 and optical sensor heads 32, while the polishing apparatus in another embodiment may include plural sets of transparent windows 33 and optical sensor heads 32.

The previous description of embodiments is provided to enable a person skilled in the art to make and use the present invention. Moreover, various modifications to these embodiments will be readily apparent to those skilled in the art, and the generic principles and specific examples defined herein may be applied to other embodiments. Therefore, the present invention is not intended to be limited to the embodiments described herein but is to be accorded the widest scope as defined by limitation of the claims.

What is claimed is:

1. A polishing apparatus comprising:

a polishing pad having a polishing surface;

a polishing head configured to press a workpiece against the polishing surface;

a transparent window disposed in the polishing pad;

a polishing table configured to support the polishing pad;

an optical sensor head located below the transparent window and configured to direct light to the workpiece through the transparent window and receive reflected light from the workpiece through the transparent window; and a cooling device configured to cool a space between the transparent window and the optical sensor head.

2. The polishing apparatus according to claim 1, wherein the cooling device has a cooling surface exposed in the space.

3. The polishing apparatus according to claim 1, further comprising an operation controller configured to control a cooling operation of the cooling device.

4. The polishing apparatus according to claim 3, wherein the operation controller is configured to instruct the cooling device to start the cooling operation after polishing of the workpiece.

5. The polishing apparatus according to claim 3, wherein the operation controller is configured to instruct the cooling device to start the cooling operation during polishing of the workpiece.

6. The polishing apparatus according to claim 3, wherein the operation controller is configured to calculate a temperature difference by subtracting a temperature in the space from a temperature of the polishing surface, and control the cooling operation of the cooling device such that the temperature difference is maintained not less than a threshold value.

7. The polishing apparatus according to claim 1, further comprising a dehumidifying device configured to reduce humidity in the space.

8. A polishing method comprising:

polishing a workpiece by pressing the workpiece against a polishing surface of a polishing pad;

during polishing of the workpiece, directing light from an optical sensor head to the workpiece through a transparent window disposed in the polishing pad, and receiving reflected light from the workpiece through the transparent window by the optical sensor head; and cooling a space between the transparent window and the optical sensor head by a cooling device.

9. The polishing method according to claim 8, wherein the cooling device has a cooling surface exposed in the space.

10. The polishing method according to claim 8, wherein cooling of the space by the cooling device is started after polishing of the workpiece.

11. The polishing method according to claim 8, wherein cooling of the space by the cooling device is started during polishing of the workpiece.

12. The polishing method according to claim 8, further comprising:

calculating a temperature difference by subtracting a temperature in the space from a temperature of the polishing surface, wherein cooling the space by the cooling device comprises cooling the space by the cooling device such that the temperature difference is maintained not less than a threshold value.

13. The polishing method of claim 8, further comprising reducing humidity in the space.

* * * * *